US010835789B1

(12) United States Patent
DeMille et al.

(10) Patent No.: US 10,835,789 B1
(45) Date of Patent: Nov. 17, 2020

(54) SUPPORT STRUCTURES FOR GOLF CLUB HEAD

(71) Applicant: Callaway Golf Company, Carlsbad, CA (US)

(72) Inventors: Brandon D. DeMille, Carlsbad, CA (US); William C. Watson, Menifee, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/836,682

(22) Filed: Mar. 31, 2020

Related U.S. Application Data

(63) Continuation-in-part of application No. 29/703,641, filed on Aug. 28, 2019, and a continuation-in-part of application No. 29/673,358, filed on Dec. 13, 2018, now Pat. No. Des. 880,631.

(60) Provisional application No. 62/892,924, filed on Aug. 28, 2019.

(51) Int. Cl.
*A63B 53/04* (2015.01)

(52) U.S. Cl.
CPC ..... *A63B 53/0487* (2013.01); *A63B 53/0412* (2020.08)

(58) Field of Classification Search
CPC ..... A63B 53/007; A63B 53/0487
USPC ..... 473/324–350
See application file for complete search history.

(56) References Cited

U.S. PATENT DOCUMENTS 1,658,581 A * 2/1928 Tobia ..... A63B 53/04 473/346
4,010,958 A * 3/1977 Long ..... A63B 53/0487 473/341
4,313,607 A * 2/1982 Thompson ..... A63B 60/00 473/328
4,511,145 A * 4/1985 Schmidt ..... A63B 60/00 473/346
5,290,032 A * 3/1994 Fenton ..... A63B 53/04 473/290
5,295,689 A * 3/1994 Lundberg ..... A63B 53/0466 473/346
5,447,307 A * 9/1995 Antonious ..... A63B 60/00 473/350
5,451,058 A * 9/1995 Price ..... A63B 53/04 473/340
5,549,297 A * 8/1996 Mahaffey ..... A63B 53/047 473/290
5,839,975 A * 11/1998 Lundberg ..... A63B 53/04 473/346
6,309,311 B1 * 10/2001 Lu ..... A63B 53/0466 473/332
6,558,271 B1 * 5/2003 Beach ..... A63B 53/0466 473/327

(Continued)

*Primary Examiner* — Alvin A Hunter
(74) *Attorney, Agent, or Firm* — Rebecca Hanovice; Michael Catania; Sonia Lari

(57) ABSTRACT

A golf club head, preferably a putter head, comprising at least one structural support member is disclosed herein. The structural support member has a smooth, organic-looking aesthetic, with a continuously changing curvature along its spline and at least one surface, and preferably connects one portion of the golf club head to another portion. Where the support member connects to other portions of the golf club head, the surfaces of the member have a curvature that changes smoothly and continuously, lacking any sharp corners.

18 Claims, 9 Drawing Sheets

(56) References Cited

U.S. PATENT DOCUMENTS 7,077,758 B2 * 7/2006 Rohrer ..... A63B 60/02 473/251
7,371,185 B1 * 5/2008 Rohrer ..... A63B 53/007 473/255
7,384,345 B2 * 6/2008 Sherman ..... A63B 53/0487 473/249
7,588,499 B2 * 9/2009 Tateno ..... A63B 53/0487 473/251
7,854,665 B2 * 12/2010 Dewhurst ..... A63B 53/0466 473/329
8,070,623 B2 * 12/2011 Stites ..... A63B 60/00 473/329
8,142,308 B2 * 3/2012 Gillig ..... A63B 60/02 473/324
8,475,292 B2 * 7/2013 Rahrig ..... A63B 60/00 473/324
8,608,585 B2 * 12/2013 Stites ..... A63B 60/00 473/282
8,915,794 B2 * 12/2014 Stites ..... A63B 53/047 473/291
9,393,471 B2 * 7/2016 Beno ..... A63B 53/0466
9,393,473 B2 * 7/2016 Knight ..... A63B 60/54
9,597,558 B1 * 3/2017 Seluga ..... A63B 60/00
9,597,561 B1 * 3/2017 Seluga ..... A63B 53/06
9,821,199 B1 * 11/2017 Seluga ..... B22D 25/00
9,855,475 B2 * 1/2018 Motokawa ..... A63B 53/0466
9,889,349 B1 * 2/2018 Seluga ..... A63B 60/42
9,901,794 B2 * 2/2018 Beno ..... A63B 60/00
9,931,550 B1 * 4/2018 Seluga ..... A63B 53/0466
9,987,527 B1 * 6/2018 Myers ..... A63B 53/06
10,258,846 B1 * 4/2019 Nunez ..... A63B 53/0466
10,384,107 B2 * 8/2019 Knight ..... A63B 60/00
10,512,826 B1 * 12/2019 Frederickson ..... A63B 60/42
10,532,258 B2 * 1/2020 Seluga ..... A63B 53/042
10,617,920 B2 * 4/2020 Nunez ..... A63B 53/0466

* cited by examiner

SUPPORT STRUCTURES FOR GOLF CLUB HEAD

CROSS REFERENCES TO RELATED APPLICATIONS

The present application claims priority to U.S. Provisional Patent Application No. 62/892,924, filed on Aug. 28, 2019, and is a continuation-in-part of U.S. Design patent application Ser. No. 29/673,358, filed on Dec. 13, 2018, and issued on Apr. 7, 2020, as U.S. Design Pat. No. D880,631, and is a continuation-in-part of U.S. Design patent application Ser. No. 29/703,641, filed on Aug. 28, 2019, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with improved structures supporting upper and lower portions of the head.

Description of the Related Art

Traditional CAD modeling techniques used to design golf club heads, and particularly putters, lend themselves to certain, angular styles or appearances. Organic-looking, smoothly curved features are more time consuming and difficult to create than traditional, angled connectors. As a result, support structures created with traditional modeling techniques tend to have common characteristics. Specifically, as shown in FIGS. 1-3, tangency T between neighboring surfaces is common, but these transitions do not typically have smooth curvatures, especially where two or more slender structural elements intersect. In fact, as shown in FIGS. 4-5, the surface curvature changes along the spline of the structural elements are discrete. Furthermore, these traditional connections are subject to increased strain and breakage. Therefore, there is a need for a golf club head, and particularly a putter, with improved structural support members and connectivity between those support members and other parts of the golf club head.

BRIEF SUMMARY OF THE INVENTION

The present invention is directed to a golf club head, and particularly a putter, comprising support structures that: (1) are less susceptible to stress concentrations during the use of the structural part or component; (2) allow for improved flow and reduced porosity in investment casting operations; (3) allow for improved flow and reduced porosity in plastic injection molding, metal injection molding, and compression molding; (4) are less susceptible to local stress concentrations and cracking during sintering; and/or (5) are less susceptible to local stress concentrations and cracking during the build process for laser-based 3D printing methods, like direct metal laser melting (DMLM) or direct metal laser sintering (DMLS). The support structures of the present invention have an "organic" appearance that is not found in prior art structural golf club parts.

Another aspect of the present invention is a golf club head comprising a body comprising face, a sole portion extending from a bottom edge of the face, and a top portion extending from a top edge of the face, and at least one support member extending from at least one of the face, sole portion, and top portion, wherein the at least one support member comprises a first end, a second end, a surface, an equivalent diameter, a spline, and a cross-sectional shape, wherein the equivalent diameter $D_E$ of a cross section taken at any point along the spline is calculated using the formula $D_E=(4*A/pi)\hat{}(½)$, wherein A is an area of a cross-section of the support member, wherein the at least one support member has a length that is greater than $D_{EA}$, wherein $D_{EA}$ is defined as the average equivalent diameter along the length of the entire support member, wherein a curvature of the surface continuously changes from the first end to the second end, wherein the equivalent diameter is always greater than 0.010 inch and less than 1.000 inch, and wherein the spline is curved and has a length that is at least three times the value of the average equivalent diameter $D_{EA}$. In some embodiments, the golf club head may be a putter head, and the at least one support member may connect the sole portion to the top portion. In a further embodiment, the at least one support member may connect to the sole portion at a first connection region and to the top portion at a second connection region, and at least one of the first and second connection region may have a constant surface curvature.

In other embodiments, a volume occupied by the at least one support member may be no greater than 75% of a volume that would be occupied if an entire volume of the golf club head between the top portion and the sole portion were a solid. In still other embodiments, the equivalent diameter may be no less than 0.025 inch and no more than 0.500 inch at any point taken along the length of the support member. In a further embodiment, the equivalent diameter may be no less than 0.050 inch and no more than 0.250 inch at any point taken along the length of the support member. In yet another embodiment, the equivalent diameter may change continuously along the entire length of the spline. In yet another embodiment, the cross-sectional shape may change continuously along the entire length of the spline. In a further embodiment, the at least one support member may comprise first and second support members, and the first support member may be connected with the second support member. In another embodiment, the at least one support member may not comprise any sharp corners. In any of the embodiments, the at least one support member may not comprise any fillets with constant surface curvature.

Yet another aspect of the present invention is a putter head comprising a face with an upper edge, a striking surface, and a lower edge, a crown portion extending from the upper edge, a sole portion extending from the lower edge, and at least one support structure connecting the crown portion to the sole portion, wherein the at least one support structure comprises a length, a width, a first end, a second end, a surface, a variable equivalent diameter, a spline, and a variable cross-sectional shape, wherein the length is greater than the average equivalent diameter, wherein the equivalent diameter $D_E$ of a cross section taken at any point along the spline is calculated using the formula $D_E=(4*A/pi)\hat{}(½)$, wherein A is an area of a cross-section of the support member, wherein the curvature of all surfaces continuously changes from the first end to the second end, wherein the equivalent diameter is greater than 0.010 inch and less than 1.000 inch and changes continuously along the length of the spline, wherein the spline is curved and has a length that is at least three times the value of the equivalent diameter, and wherein the cross-sectional shape changes continuously along the length of the spline.

In some embodiments, the at least one support member may extend at an angle of less than 75° from the sole portion. In other embodiments, the at least one support member does not comprise any sharp corners or simple fillets with constant surface structure. In still other embodiments, the at least one support member may comprise at least six support members, and each of the support members may extend at an angle with respect to the crown portion and the sole portion. In another embodiment, the at least one support member may connect with the sole portion at a first connection region, the at least one support member may connect with the crown portion at a second connection region, and at least one of the first and second connection regions may have a constant surface curvature. In any of the embodiments, the equivalent diameter may be no less than 0.025 inch and no more than 0.500 inch at any point taken along the length of the support member. In a further embodiment, the equivalent diameter may be no less than 0.050 inch and no more than 0.250 inch at any point taken along the length of the support member.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
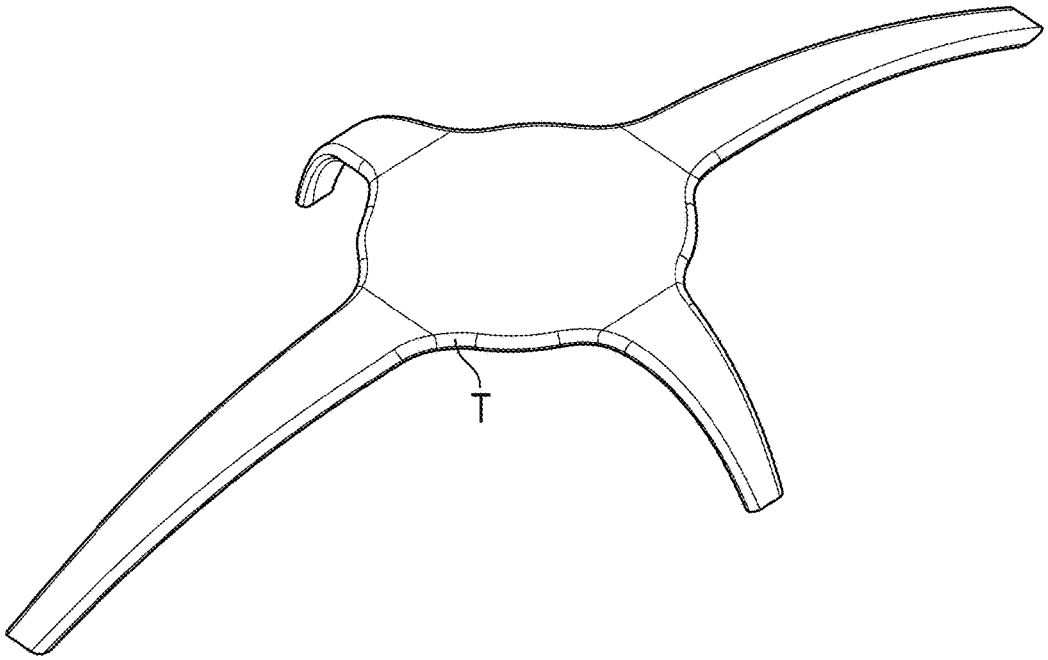
FIG. 1 is top perspective view of a first prior art support structure.
Figure 2:
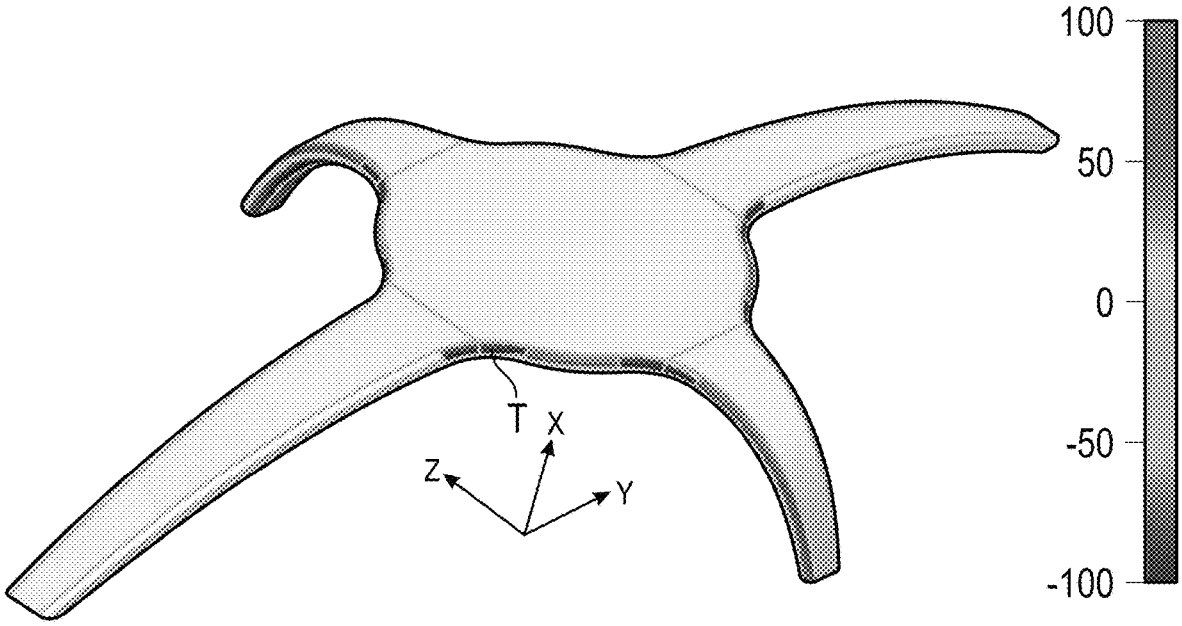
FIG. 2 is a top perspective view of a second prior art support structure.
Figure 3:
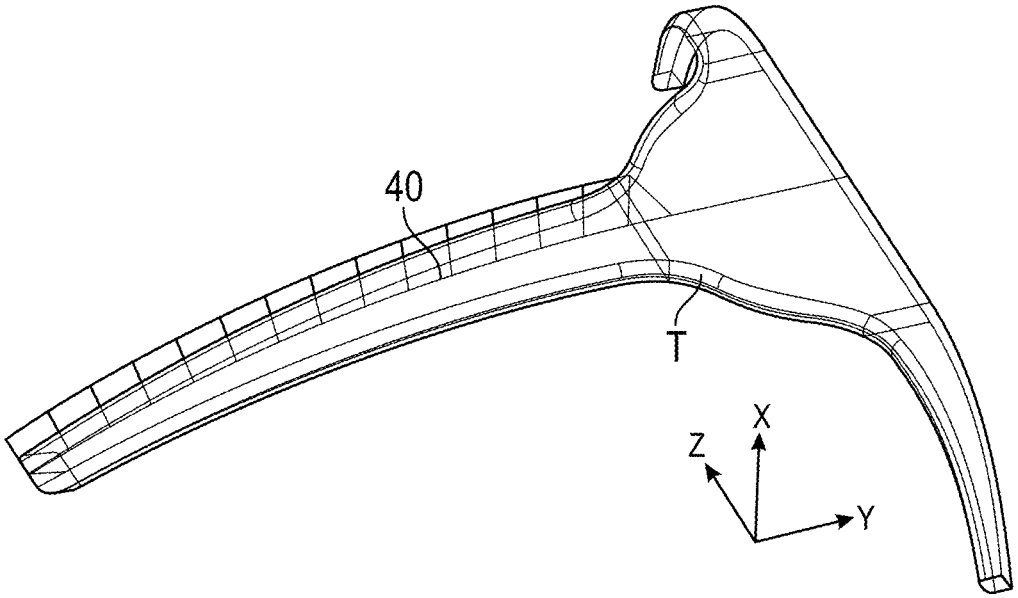
FIG. 3 is a line drawing of a third prior art support structure.
Figure 4:
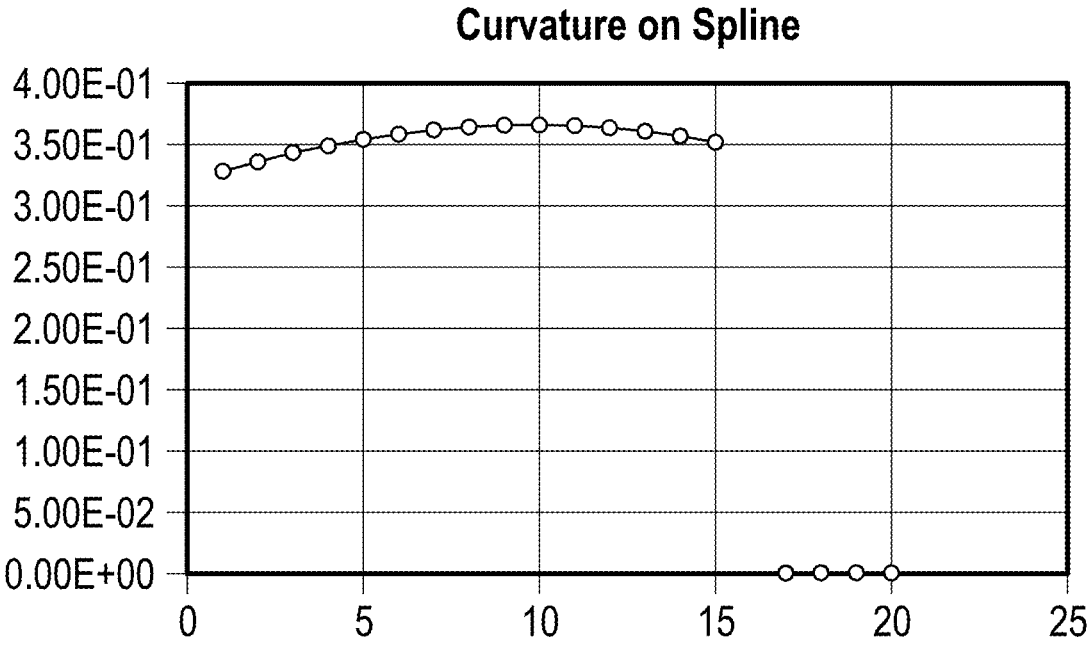
FIG. 4 is a graph showing the curvature of the spline of the embodiment shown in FIG. 3.
Figure 5:
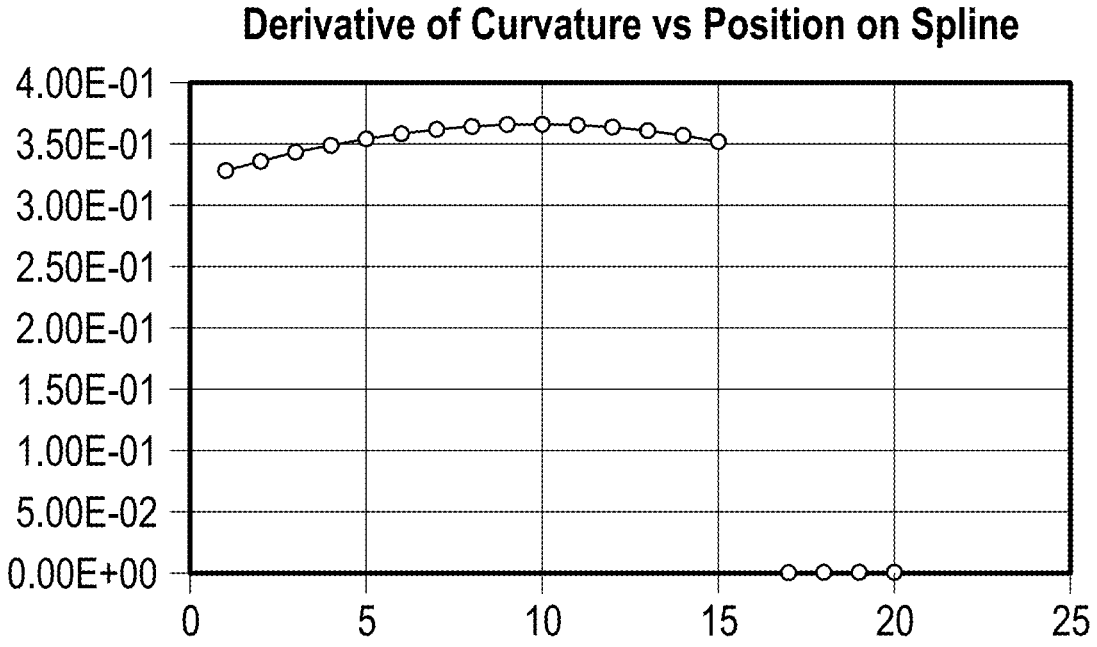
FIG. 5 is a graph showing the derivative of curvature vs. position on spline of the embodiment shown in FIG. 3.
Figure 6:
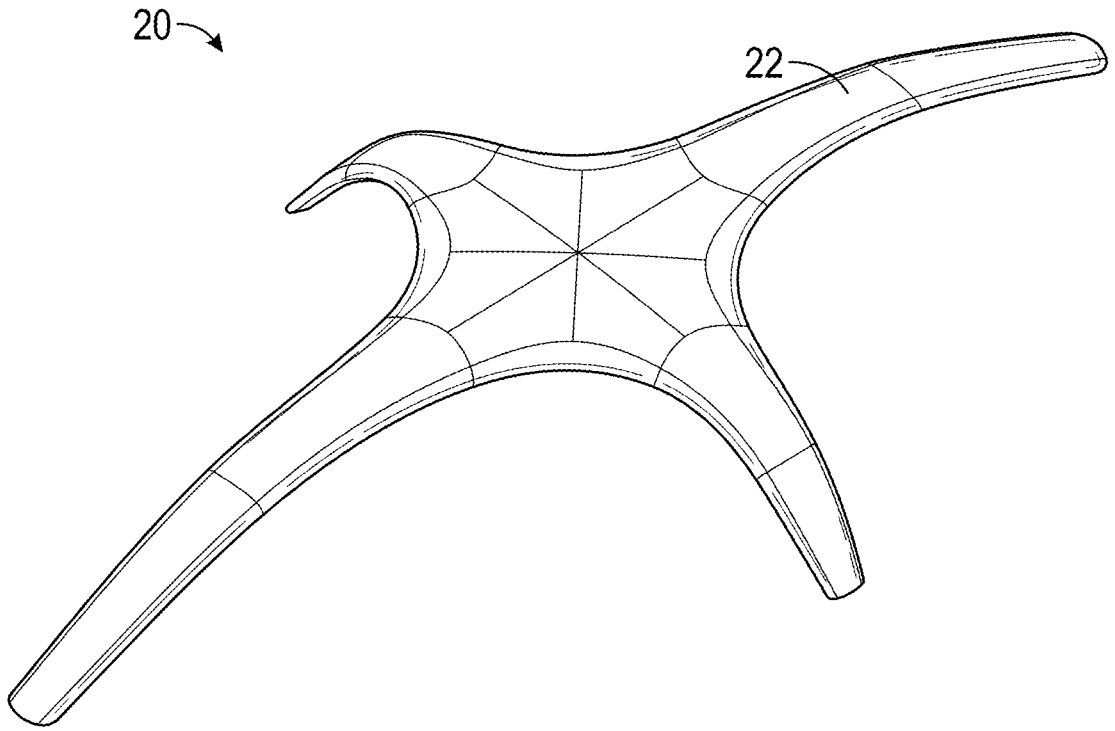
FIG. 6 is a top perspective view of a first embodiment of the support member of the present invention.
Figure 7:
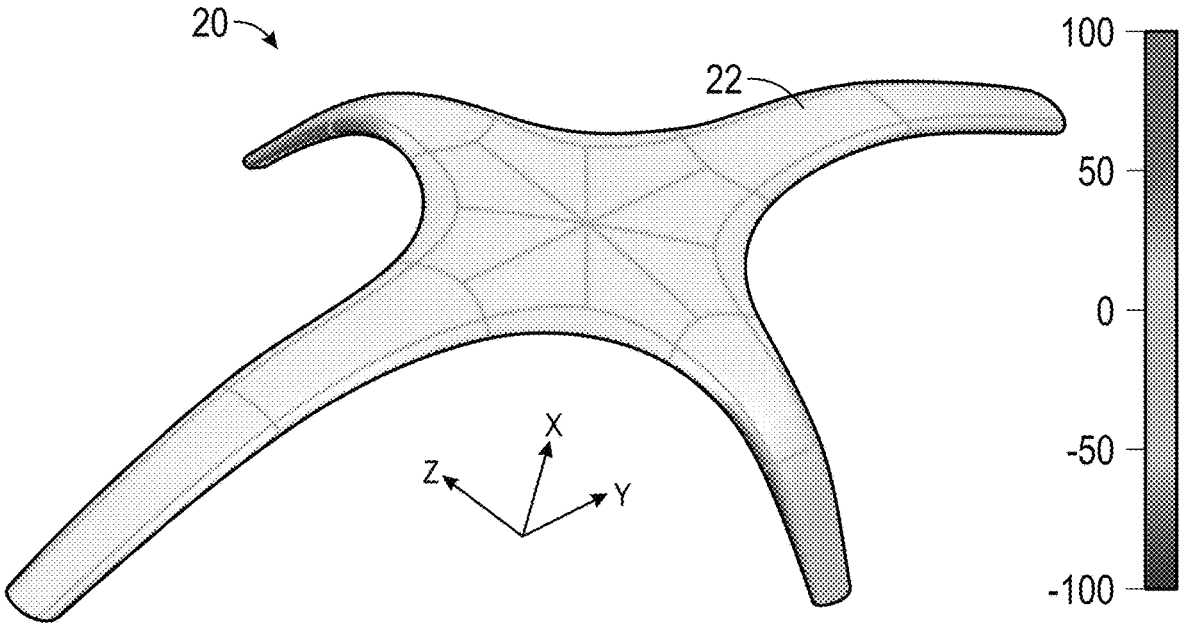
FIG. 7 is a top perspective view of a second embodiment of the support member of the present invention.
Figure 8:
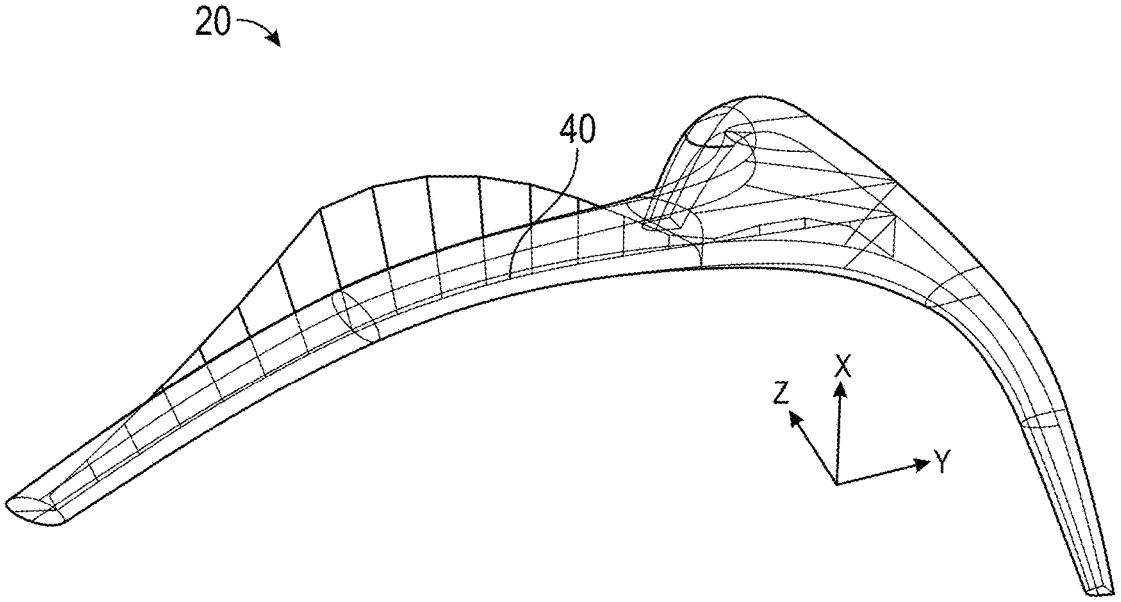
FIG. 8 line drawing of a third embodiment of the support member of the present invention.

The present invention is directed to a golf club head, and particularly a putter head 10, with improved structural support members 20. The putter head 10 comprises a face 16, a sole portion 12 extending from a lower edge 18 of the face 16, and a top or crown portion 14 extending from an upper edge 17 of the face 16. Though the embodiments herein are directed to a putter head, the novel features disclosed herein may be used in connection with other types of golf club heads, such as drivers, fairway woods, irons, and wedges.

In order to attain an optimized design for the support members 20, the relationship between curvature, rate of change of curvature, spline length, cross-sectional area, and cross-sectional shape of each structure must be examined. By controlling each of these geometric features, support members 20 can be created that are much improved over existing prior art support structures within golf club heads.

Figure 13:
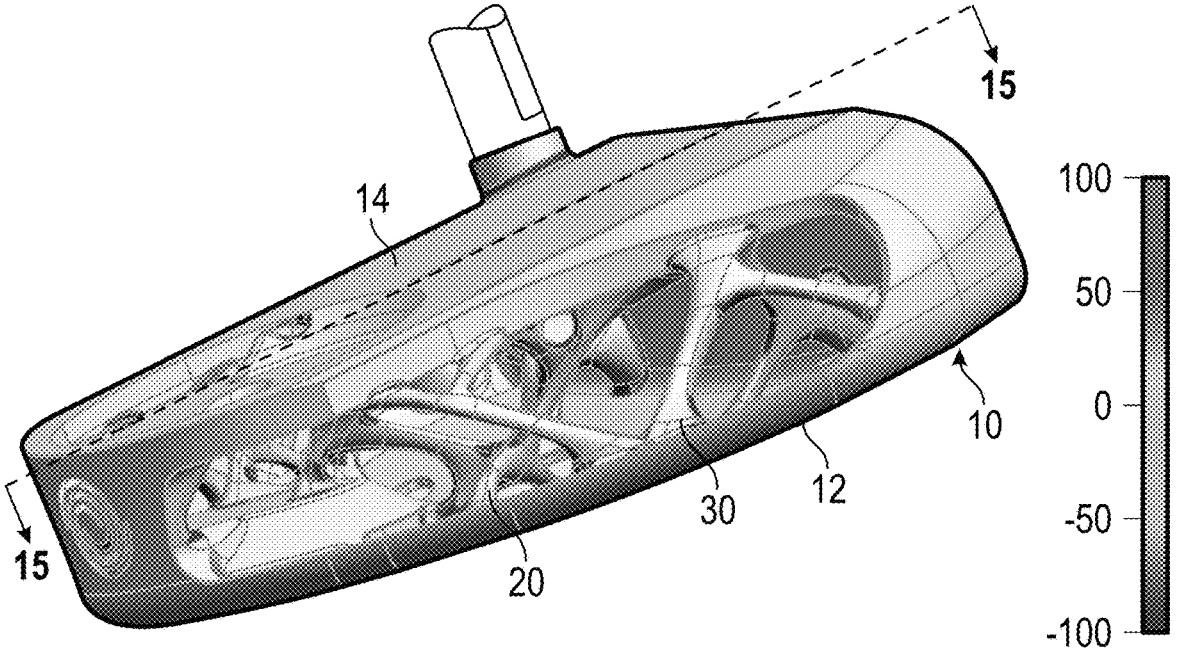
FIG. 13 is a rear perspective view of the putter head shown in FIG. 12 without the enclosed volume shading and incorporating a plurality of support members of the present invention.
Figure 14:
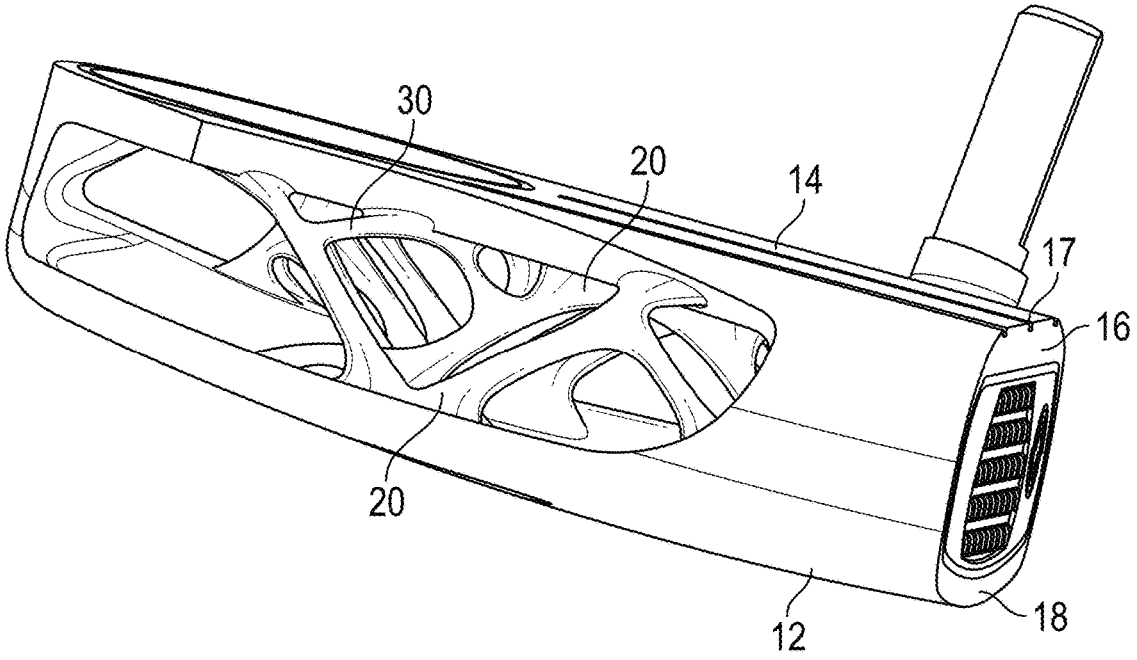
FIG. 14 is a side view of the embodiment shown in FIG. 13.
Figure 15:
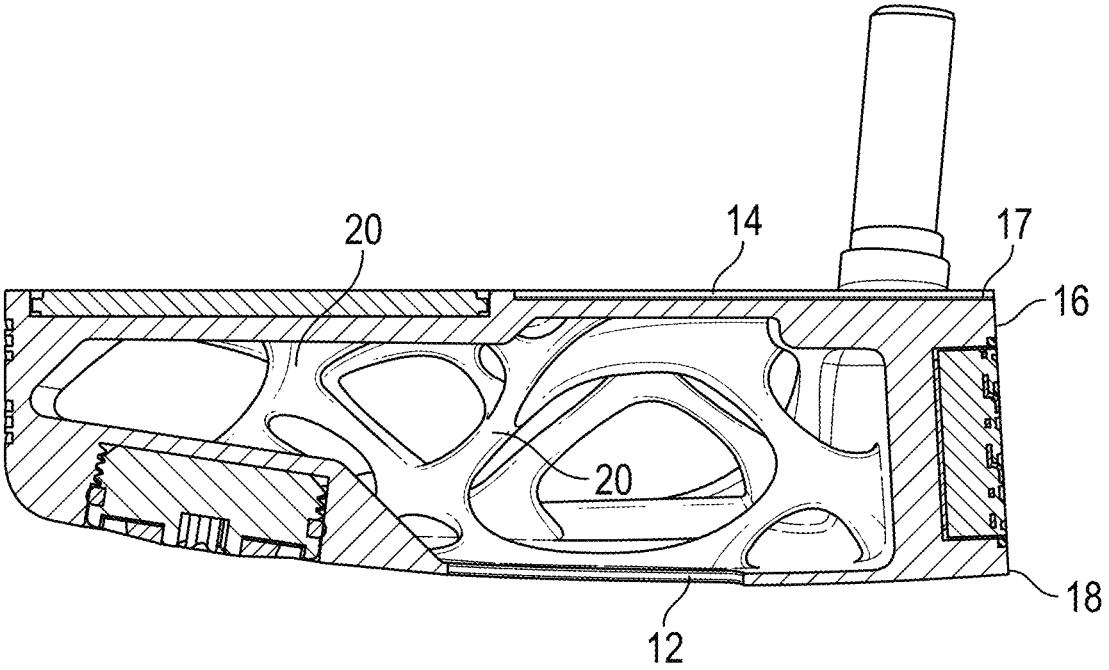
FIG. 15 is a cross-sectional view of the putter head shown in FIG. 13 along lines 15-15.

The support members 20 of the present invention include networks of slender connected elements, and may also be referred to as rods, beams, or ligaments. Each support member 20 is either connected to another support member 20 or to the surface of another type of structure, such as a sole portion 12 or top or crown portion 14 of the putter head 10. In the preferred embodiment shown in FIG. 13-15, the support members connect the sole portion 12 to the crown portion 14, but in an alternative embodiment, the support members may attach only to a single surface, such as the face 16. Some support members 20 also have at least one connection to another support member 20.

At the connection to another support member 20, the surfaces 22 of the support member 20 have a curvature that changes smoothly and continuously. There are no sharp corners and there are no simple fillets with constant surface curvature.

Figure 9:
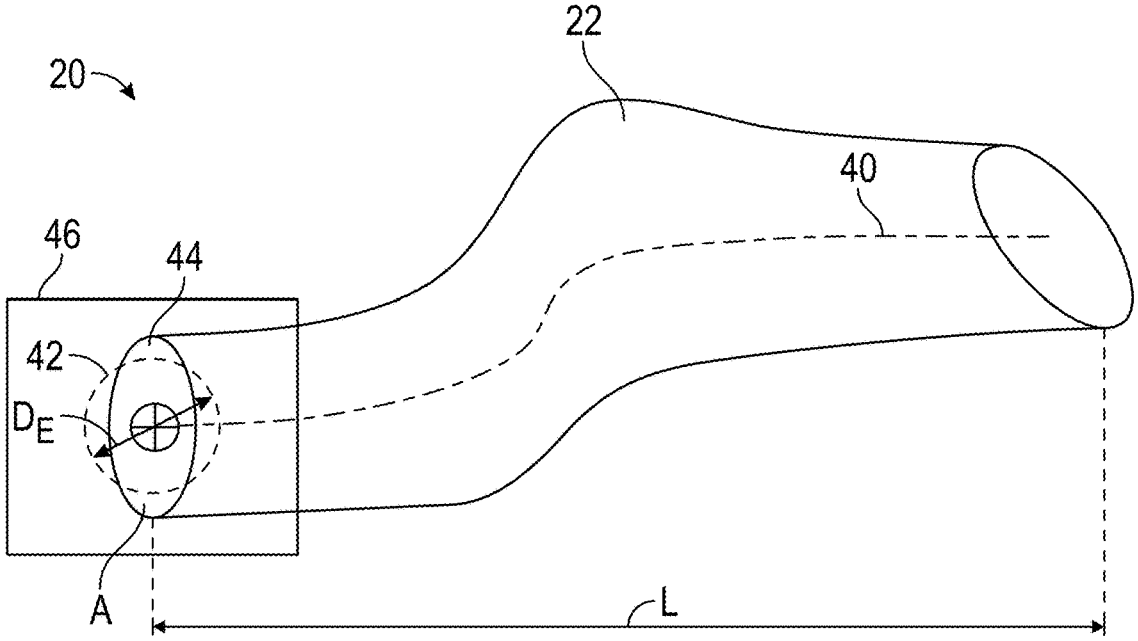
FIG. 9 is a line drawing of a fourth embodiment of the support member of the present invention.

As shown in FIG. 9, for each support member 20, the equivalent diameter $D_E$ is the diameter of a circle 42 with the same area A as the cross section 44 of the support member 20. The cross section 44 is taken in the plane 46 normal to the spline 40 running through the center of the support member 20 along its length. The support member 20 cross section 44 has an area A, and the equivalent diameter $D_E$ is defined as $D_E=(4*A/pi)\hat{}(½)$.

The length of the spline 40 is no less than three times the equivalent diameter $D_E$. The equivalent diameter $D_E$ and the cross sectional shape 44 change continuously along the length of each spline 40, but the equivalent diameter $D_E$ is always greater than 0.010" and always less than 1.000", more preferably 0.050"-0.500," and most preferably 0.050"-0.250".

Figure 10:
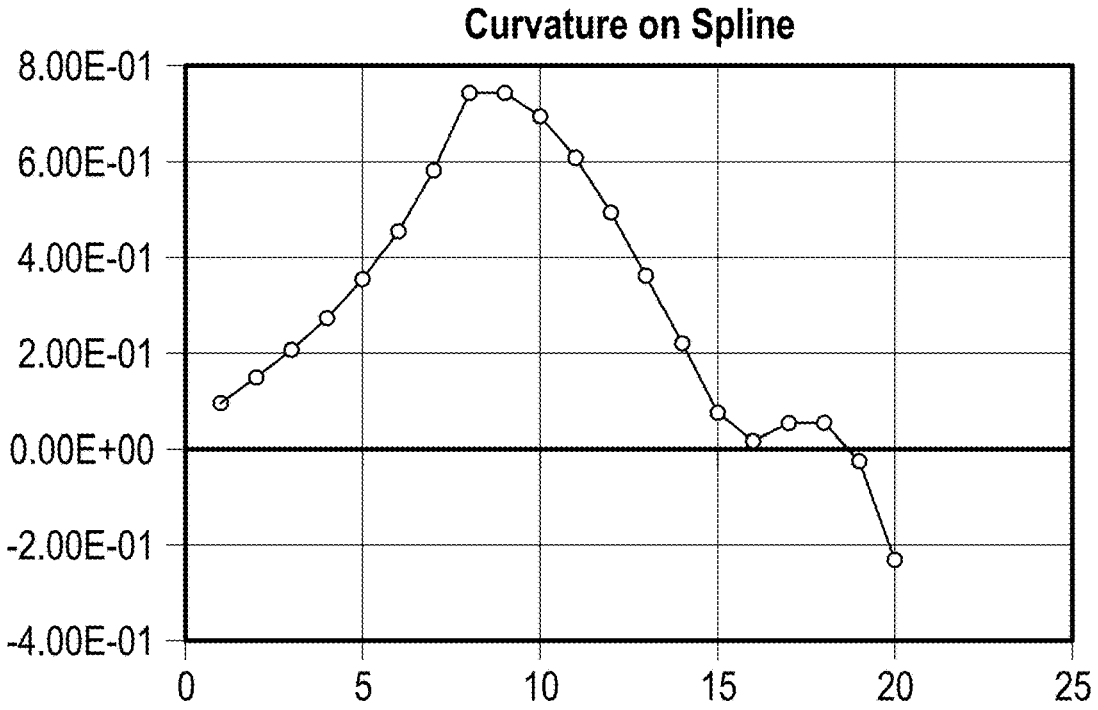
FIG. 10 is a graph showing the curvature of the spline of the embodiment shown in FIG. 8.
Figure 11:
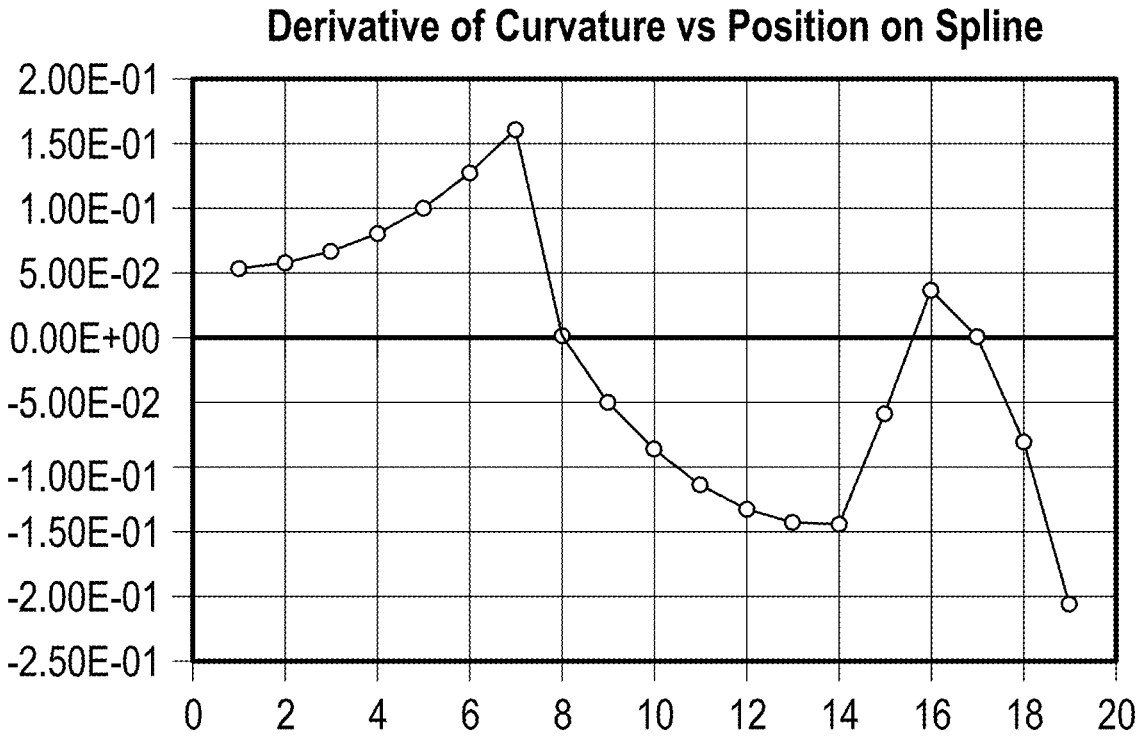
FIG. 11 is a graph showing the derivative of curvature vs. position on spline of the embodiment shown in FIG. 8.
Figure 12:
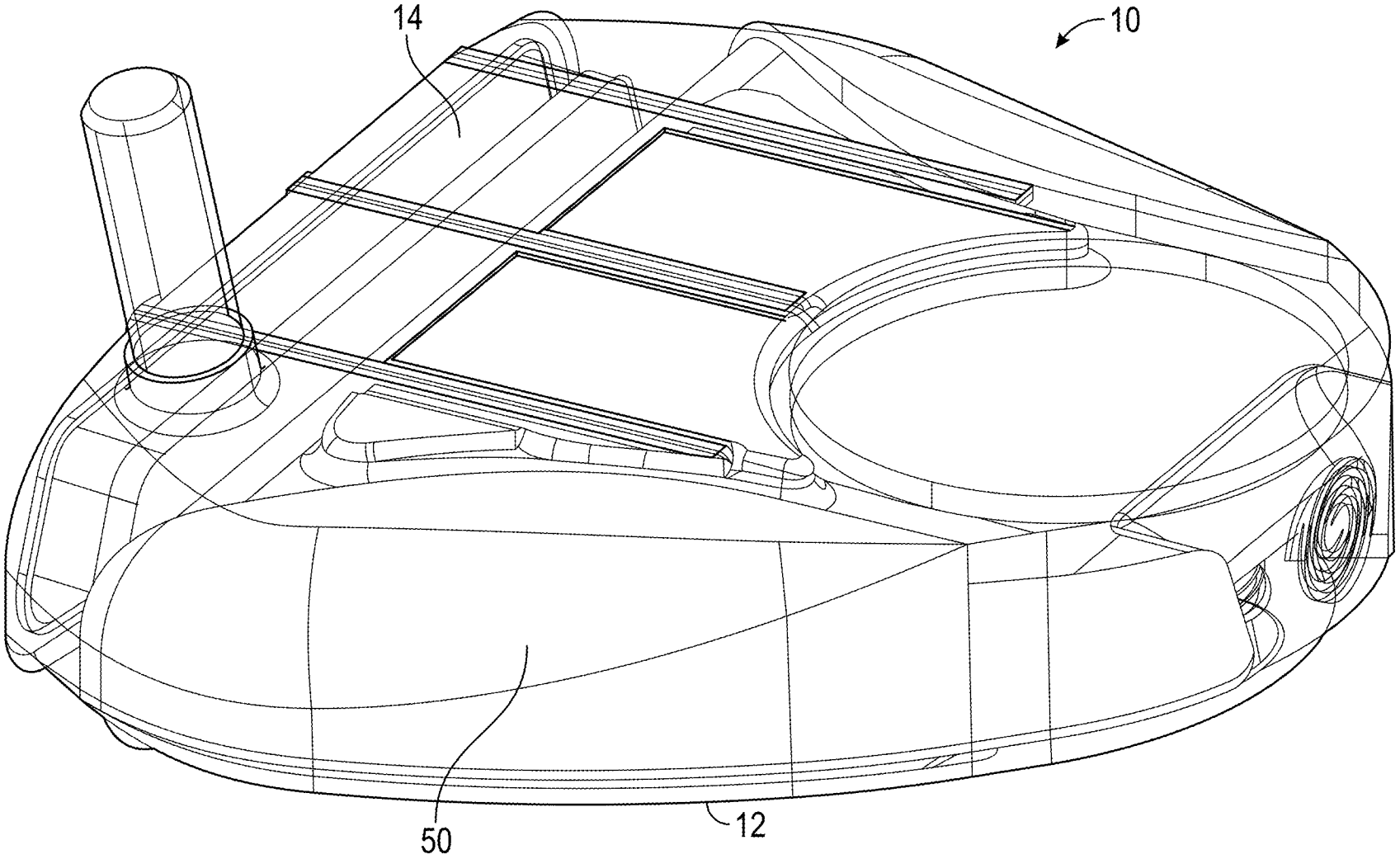
FIG. 12 is a side perspective view of a putter head with shading representing an enclosed volume.

As shown in FIGS. 6-9, each spline 40 is curved, and as illustrated in FIGS. 10-11, the curvature continuously changes along the length of the spline 40, with specific ranges of curvature and rates of change of curvature. The entire network of support members 20 occupies a volume 30 that is no greater than 75% of the enveloping volume 50. The enveloping volume 50, which is illustrated in FIG. 12, is the total volume that could be occupied by support members 20 given the application.

The support members 20 disclosed herein are preferably manufactured via 3D printing. In alternative embodiments, the support members 20 may be manufactured via other methods known to a person skilled in the art, such as investment casting, plastic injection molding, compression molding, forging, forming, and metal injection molding.

When compared with prior art structural members, the support members 20 disclosed herein (1) are less susceptible to stress concentrations during the use of the structural part or component, (2) allow for improved flow and reduced porosity in investment casting operations, (3) allow for improved flow and reduced porosity in plastic injection molding, metal injection molding, compression molding, (4) are less susceptible to local stress concentrations and cracking during sintering of metal injection molding or 3D printed parts, and (5) are less susceptible to local stress concentrations and cracking during the build process for laser-based 3D printing methods, like direct metal laser melting (DMLM) or direct metal laser sintering (DMLS). The support members 20 of the present invention also have a unique "organic" appearance that is not found in prior art structural golf club parts.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising face, a sole portion extending from a bottom edge of the face, and a top portion extending from a top edge of the face; and at least one support member extending from at least one of the face, sole portion, and top portion, wherein the at least one support member comprises a first end, a second end, a surface, an equivalent diameter, a spline, and a cross-sectional shape, wherein the equivalent diameter $D_E$ of a cross section taken at any point along the spline is calculated using the formula $D_E$=(4*A/pi)^(½), wherein A is an area of a cross-section of the support member, wherein the at least one support member has a length that is greater than $D_{EA}$, wherein $D_{EA}$ is defined as the average equivalent diameter along the length of the entire support member, wherein a curvature of the surface continuously changes from the first end to the second end, wherein the equivalent diameter is always greater than 0.010 inch and less than 1.000 inch, and wherein the spline is curved and has a length that is at least three times the value of the average equivalent diameter $D_{EA}$.

2. The golf club head of claim 1, wherein the golf club head is a putter head, and wherein the at least one support member connects the sole portion to the top portion.

3. The golf club head of claim 2, wherein the at least one support member connects to the sole portion at a first connection region and to the top portion at a second connection region, and wherein at least one of the first and second connection region has a constant surface curvature.

4. The golf club head of claim 1, wherein a volume occupied by the at least one support member is no greater than 75% of a volume that would be occupied if an entire volume of the golf club head between the top portion and the sole portion were a solid.

5. The golf club head of claim 1, wherein the equivalent diameter is no less than 0.025 inch and no more than 0.500 inch at any point taken along the length of the support member.

6. The golf club head of claim 5, wherein the equivalent diameter is no less than 0.050 inch and no more than 0.250 inch at any point taken along the length of the support member.

7. The golf club head of claim 1, wherein the equivalent diameter changes continuously along the entire length of the spline.

8. The golf club head of claim 1, wherein the cross-sectional shape changes continuously along the entire length of the spline.

9. The golf club head of claim 1, wherein the at least one support member comprises first and second support members, and wherein the first support member is connected with the second support member.

10. The golf club head of claim 1, wherein the at least one support member does not comprise any sharp corners.

11. The golf club head of claim 1, wherein the at least one support member does not comprise any fillets with constant surface curvature.

12. A putter head comprising:

a face with an upper edge, a striking surface, and a lower edge;

a crown portion extending from the upper edge;

a sole portion extending from the lower edge; and at least one support structure connecting the crown portion to the sole portion, wherein the at least one support structure comprises a length, a width, a first end, a second end, a surface, a variable equivalent diameter, a spline, and a variable cross-sectional shape, wherein the length is greater than the average equivalent diameter, wherein the equivalent diameter $D_E$ of a cross section taken at any point along the spline is calculated using the formula $D_E$=(4*A/pi)^(½), wherein A is an area of a cross-section of the support member, wherein the curvature of all surfaces continuously changes from the first end to the second end, wherein the equivalent diameter is greater than 0.010 inch and less than 1.000 inch and changes continuously along the length of the spline, wherein the spline is curved and has a length that is at least three times the value of the equivalent diameter, and wherein the cross-sectional shape changes continuously along the length of the spline.

13. The putter head of claim 12, wherein the at least one support member extends at an angle from the sole portion, and wherein the angle is less than 75°.

14. The putter head of claim 12, wherein the at least one support member does not comprise any sharp corners or simple fillets with constant surface structure.

15. The putter head of claim 12, wherein the at least one support member comprises at least six support members, and wherein each of the support members extends at an angle with respect to the crown portion and the sole portion.

16. The putter head of claim 12, wherein the at least one support member connects with the sole portion at a first connection region, wherein the at least one support member connects with the crown portion at a second connection region, and wherein at least one of the first and second connection region has a constant surface curvature.

17. The putter head of claim 12, wherein the equivalent diameter is no less than 0.025 inch and no more than 0.500 inch at any point taken along the length of the support member.

18. The putter head of claim 17, wherein the equivalent diameter is no less than 0.050 inch and no more than 0.250 inch at any point taken along the length of the support member.

* * * * *